US010950953B2

(12) United States Patent
Ren et al.

(10) Patent No.: US 10,950,953 B2
(45) Date of Patent: Mar. 16, 2021

(54) ANTENNA UNIT, MIMO ANTENNA AND HANDHELD DEVICE

(71) Applicant: SHENZHEN SUNWAY COMMUNICATION CO., LTD., Guangdong (CN)

(72) Inventors: Zhouyou Ren, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 0 days.

(21) Appl. No.: 16/474,818

(22) PCT Filed: Jan. 14, 2019

(86) PCT No.: PCT/CN2019/071574
§ 371 (c)(1),
(2) Date: Jun. 28, 2019

(87) PCT Pub. No.: WO2019/137522
PCT Pub. Date: Jul. 18, 2019

(65) Prior Publication Data

US 2020/0243984 A1 Jul. 30, 2020

(30) Foreign Application Priority Data

Jan. 15, 2018 (CN) ..... 201810035964.8

(51) Int. Cl.
*H01Q 1/24* (2006.01)
*H01Q 21/08* (2006.01)
*H01Q 1/48* (2006.01)

(52) U.S. Cl.
CPC ..... *H01Q 21/08* (2013.01); *H01Q 1/243* (2013.01); *H01Q 1/48* (2013.01)

(58) Field of Classification Search
CPC ..... H01Q 1/48; H01Q 1/38; H01Q 1/22–24; H01Q 21/06–08
See application file for complete search history.

(56) References Cited

U.S. PATENT DOCUMENTS 9,331,396 B2 * 5/2016 Tran ..... H01Q 21/24
9,496,614 B2 * 11/2016 Bringuier ..... H01Q 21/30
(Continued)

FOREIGN PATENT DOCUMENTS

CN 104638356 A 5/2015
CN 104701623 A 6/2015
(Continued)

OTHER PUBLICATIONS

Jun. 25, 2019 Office Action issued in Chinese Patent Application No. 201810035964.8.
(Continued)

*Primary Examiner* — Hasan Z Islam
(74) *Attorney, Agent, or Firm* — Oliff PLC

(57) ABSTRACT

An antenna unit, a MIMO antenna and a handheld device. The antenna unit includes a feeder and a radiator, wherein the radiator is in a 90°-rotated U shape and includes a first horizontal part, a first vertical part and a second horizontal part, two ends of the first vertical part are respectively connected to the first horizontal part and the second horizontal part; the feeder is located in the U shape and includes a second vertical part, a third horizontal part and a third vertical part, two ends of the third horizontal part are respectively connected to the second vertical part and the third vertical part, and the second vertical part and the third vertical part are located on different sides of the third horizontal part. The MIMO antenna has an ultra wideband.

14 Claims, 4 Drawing Sheets

(56) References Cited

U.S. PATENT DOCUMENTS

| | | | | |
|---|---|---|---|---|
| 10,122,076 | B2 * | 11/2018 | Maas | H01Q 9/0407 |
| 10,164,342 | B2 * | 12/2018 | Arias | F41H 5/0414 |
| 10,454,156 | B1 * | 10/2019 | Yang | H01Q 5/335 |
| 2014/0191918 | A1 * | 7/2014 | Cheng | H01Q 21/205 343/834 |
| 2014/0375515 | A1 | 12/2014 | Qiu et al. | |
| 2015/0295311 | A1 * | 10/2015 | Bringuier | H01Q 9/0407 343/729 |
| 2017/0352945 | A1 * | 12/2017 | Chang | H01Q 1/36 |

FOREIGN PATENT DOCUMENTS

| | | | |
|---|---|---|---|
| CN | 105161837 | A | 12/2015 |
| CN | 105470644 | A | 4/2016 |
| CN | 106374226 | A | 2/2017 |
| CN | 106910986 | A | 6/2017 |
| CN | 206595397 | U | 10/2017 |
| CN | 108493590 | A | 9/2018 |
| CN | 207910050 | U | 9/2018 |

OTHER PUBLICATIONS

Apr. 16, 2019 International Search Report issued in International Patent Application No. PCT/CN2019/071574.

* cited by examiner

ANTENNA UNIT, MIMO ANTENNA AND HANDHELD DEVICE

TECHNICAL FIELD

The invention relates to the technical field of mobile communications, in particular to an antenna unit, a MIMO antenna and a handheld device.

DESCRIPTION OF RELATED ART

The fifth-generation mobile communication technology (5G) will be commercially used on a large scale in 2020, and in the next few years, new mobile terminal antennas and base station antennas will have a broad application market. In the fourth-generation mobile communication (4G) system, 2*2 multiple-input multiple-output (MIMO) antennas have been widely studied and applied to handheld mobile devices. In terms of existing study of various countries, the peak rate of 5G will be increased by tens of times compared with 4G, and thus, 2*2 or 4*4 MIMO antenna structures cannot meet the requirements of a 5G system for the transmission rate and the connection reliability anymore. MIMO antenna structures including more antennas units, such as 6*6 or 8*8 MIMO antennas, in the 5G system will be applied to handheld devices to realize a higher channel capacity and a better communication quality. In addition, the MIMO antenna structures including more antenna units can solve the problem of multipath fading and can also improve the data throughout.

MIIT has released, on Nov. 9, 2017, the 5G frequency bands and has planned the frequency band of 3.3 GHz-3.6 GHz and the frequency band of 4.8 GHz-5 GHz as operating frequency bands of the 5G system in China, wherein the frequency band of 3.3 GHz-3.4 GHz is for indoor use only in principle. Therefore, how to design a multi-antenna MIMO antenna structure capable of covering all the frequency bands mentioned above has become a new study direction at present. In addition, because the handheld devices are becoming thinner and thinner and are having a narrower and narrower frame (full screen), the MIMO antenna structure both meeting the requirement for the antenna efficiency and meeting the requirement for the isolation between antennas is becoming more and more complex.

In view of this, it is necessary to design a structure of an ultra-wideband antenna unit and an ultra-wideband MIMO antenna comprising the ultra-wideband antenna unit to make handheld devices equipped with the MIMO antenna system cover all operating frequency bands below 6 GHz of the 5G system.

BRIEF SUMMARY OF THE INVENTION

The technical issue to be settled by the invention is to provide an ultra-wideband antenna unit, an ultra-wideband MIMO antenna provided with the ultra-wideband antenna unit, and a handheld device provided with the ultra-wideband MIMO antenna.

One technical solution adopted by the invention to settle the above-mentioned technical issue is as follows: an antenna unit comprises a feeder and a radiator, wherein the radiator is in a 90°-rotated U shape and comprises a first horizontal part, a first vertical part and a second horizontal part, and two ends of the first vertical part are respectively connected to the first horizontal part and the second horizontal part; the feeder is located in the U shape and comprises a second vertical part, a third horizontal part and a third vertical part, two ends of the third horizontal part are respectively connected to the second vertical part and the third vertical part, and the second vertical part and the third vertical part are located on different sides of the third horizontal part; and a first slot is formed between the third horizontal part and the first horizontal part, the second vertical part is close to the first vertical part, and a second slot is formed between the second vertical part and the first vertical part.

Another technical solution adopted by the invention is as follows: a MIMO antenna comprises an ground plate provided with a plurality of antenna units mentioned above, wherein the antenna units are arranged perpendicular to the upper surface of the ground plate, the first horizontal parts of the antenna units are connected to the ground plate, and the plurality of antenna units are divided into two antenna unit groups which are respectively arranged on two long edges of the ground plate.

The following technical solution is also adopted by the invention: a handheld device is provided with the MIMO antenna mentioned above.

The invention has the following beneficial effects: the antenna unit generates two adjacent dual resonances by means of the structures of the feeder and the radiator, as well as the first slot and the second slot, and thus, the antenna unit has an ultra wideband and is simple in structure, convenient to machine, and low in manufacturing cost.

REFERENCE SIGNS

1, feeder;
11, second vertical part;
12, third horizontal part;
13, third vertical part;
2, radiator;
21, first horizontal part;
22, first vertical part;
23, second horizontal part;
41, first slot;

42, second slot;
5, ground plate;
6, first antenna unit;
7, second antenna unit;
8, third antenna unit;
9, fourth antenna unit.

DETAILED DESCRIPTION OF THE INVENTION

The technical solutions, objectives, and effects of the invention are expounded below with reference to embodiments and accompanying drawings.

The key conception of the invention lies in that the antenna unit generates two adjacent dual resonances by means of the structures of a feeder and a radiator, as well as a first slot and a second slot.

Figure 1:
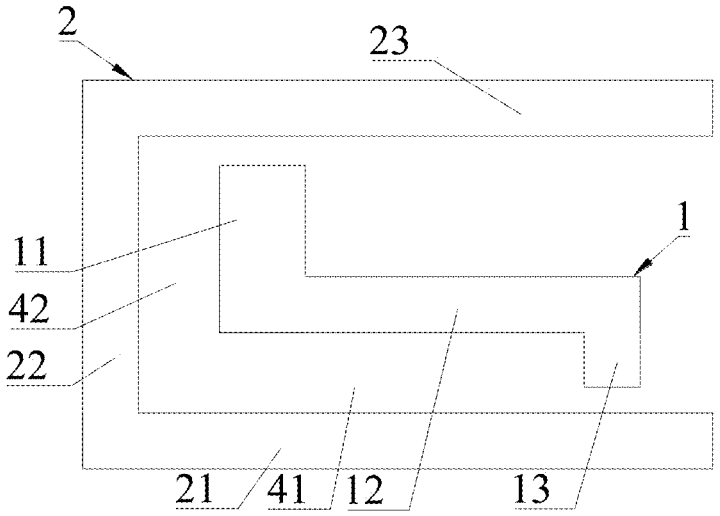
FIG. 1 is a front view of an antenna unit in embodiment 1 of the invention.

Referring to FIG. 1, the antenna unit comprises a feeder 1 and a radiator 2. The radiator 2 is in a 90.degree.-rotated U shape and comprises a first horizontal part 21, a first vertical part 22 and a second horizontal part 23, wherein two ends of the first vertical part 22 are respectively connected to the first horizontal part 21 and the second horizontal part 23. The feeder 1 is located in the U shape and comprises a second vertical part 11, a third horizontal part 12 and a third vertical part 13, wherein two ends of the third horizontal part 12 are respectively connected to the second vertical part 11 and the third vertical part 13, and the second vertical part 11 and the third vertical part 13 are located on different sides of the third horizontal part 12. A first slot 41 is formed between the third horizontal part 12 and the first horizontal part 21, the second vertical part 11 is close to the first vertical part 22, and a second slot 42 is formed between the second vertical part 11 and the first vertical part 22.

From the above description, the invention has the following beneficial effects: the antenna unit generates two adjacent dual resonances by means of the structures of the feeder and the radiator, as well as the first slot and the second slot, and thus, the antenna unit has an ultra wideband and is simple in structure, convenient to machine, and low in manufacturing cost.

Referring to FIGS. 2-9, a MIMO antenna comprises an ground plate 5 which is provided with a plurality of antenna units, wherein the antenna units are arranged perpendicular to the upper surface of the ground plate 5, and the first horizontal parts 21 of the antenna units are connected to the ground plate 5; and the plurality of antenna units are divided into two antenna unit groups which are respectively arranged on two long edges of the ground plate 5.

From the above description, the MIMO antenna is provided with a plurality of ultra-wideband antenna units, so that the performance of the MIMO antenna is greatly improved.

Furthermore, the number of the antenna units in one antenna unit group is equal to the number of the antenna units in the other antenna unit group.

Furthermore, each antenna unit group includes a first antenna unit 6, a second antenna unit 7, a third antenna unit 8 and a fourth antenna unit 9 which are sequentially arranged along one long edge of the ground plate 5, wherein the first antenna unit 6 and the fourth antenna unit 9 are symmetrically arranged with respect to an axis which penetrates through the central point of the long edge and is perpendicular to the upper surface of the ground plate 5, and the second antenna unit 7 and the third antenna unit 8 are symmetrically arranged with respect to the axis which penetrates through the central point of the long edge and is perpendicular to the upper surface of the ground plate 5.

Furthermore, the radiator of the first antenna unit 6 and the radiator of the second antenna unit 7 are open in the same direction, the radiator of the third antenna unit 8 and the radiator of the fourth antenna 9 are open in the same direction, and the radiator of the third antenna 8 and the radiator of the first antenna unit 6 are open in opposite directions; and the distance between the second antenna unit 7 and the third antenna unit 8 is greater than the distance between the second antenna unit 7 and the first antenna unit 6.

Furthermore, the radiator of the first antenna unit 6 and the radiator of the third antenna unit 8 are open in the same direction, the radiator of the second antenna unit 7 and the radiator of the fourth antenna unit 9 are open in the same direction, and the radiator of the second antenna unit 7 and the radiator of the first antenna unit 6 are open in opposite directions; and the distance between the second antenna unit 7 and the third antenna unit 8 is smaller than the distance between the second antenna unit 7 and the first antenna unit 6.

Furthermore, each antenna unit group includes a first antenna unit 6, a second antenna unit 7, a third antenna unit 8 and a fourth antenna unit 9 which are sequentially arranged along one long edge of the ground plate 5, wherein the radiator of the first antenna unit 6, the radiator of the second antenna unit 7 and the radiator of the third antenna unit 8 are open in the same direction, and the radiator of the fourth antenna unit 9 and the radiator of the first antenna unit 6 are open in opposite directions; and the distance between the first antenna unit 6 and the second antenna unit 7 is equal to the distance between the second antenna unit 7 and the third antenna unit 8 and is smaller than the distance between the third antenna unit 8 and the fourth antenna unit 9.

From the above description, the grounded radiators in the antenna units have an isolation effect, so that the distance between the two adjacent antenna units (arrayed in a "][" shape) which are open in opposite directions and have the two first vertical parts close to each other is very small, the distance between the two adjacent antenna units (arrayed in a "]]" shape or in a "[[" shape) which are open in the same direction is relatively small, and the distance between the two adjacent units (arrayed in a "[]" shape) which are open in opposite directions and have the two first vertical parts away from each other is large, so that the isolation between two adjacent antennas is ensured.

A handheld device is provided with the MIMO antenna.

Furthermore, the handheld device comprises a shell and a PCB arranged in the shell, wherein the ground plate 5 serves as the PCB, and the feeders 1 of the antenna units are fixed to the inner wall of the shell.

Embodiment 1

Please refer to FIGS. 1-9. Embodiment 1: as shown in FIG. 1, the antenna unit comprises a feeder 1 and a radiator 2, wherein the radiator 2 is in a 90°-rotated U shape and comprises a first horizontal part 21, a first vertical part 22 and a second horizontal part 23, and two ends of the first vertical part 22 are respectively connected to the first horizontal part 21 and the second horizontal part 23; the feeder 1 is located in the U shape and comprises a second vertical part 11, a third horizontal part 12 and a third vertical part 13, two ends of the third horizontal part 12 are respectively connected to the second vertical part 11 and the third vertical part 13, and the second vertical part 11 and the third vertical part 13 are located on different sides of the third horizontal part 12; and a first slot 41 is formed between the third horizontal part 12 and the first horizontal part 21, the second vertical part 11 is close to the first vertical part 22, a second slot 42 is formed between the second vertical part 11 and the first vertical part 22, and the first slot 41 is connected to the second slot 42.

Figure 2:
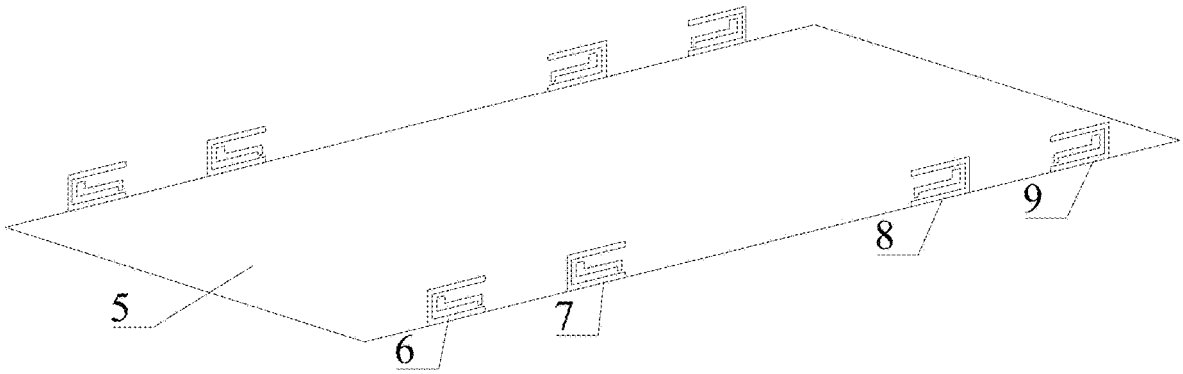
FIG. 2 is a structure view of a MIMO antenna in embodiment 1 of the invention.
Figure 3:
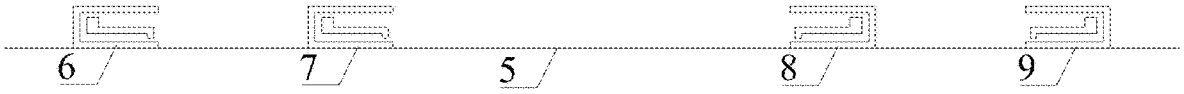
FIG. 3 is a side view of the MIMO antenna in embodiment 1 of the invention.

As shown in FIG. 2 and FIG. 3, a MIMO antenna comprises an ground plate 5 provided with a plurality of antenna units mentioned above, wherein the antenna units are arranged perpendicular to the upper surface of the ground plate 5, and the first horizontal parts 21 of the antenna units are connected to the ground plate 5; in the antenna units, the second vertical parts 11 are located on the sides, away from the first horizontal parts 21, of the third horizontal parts 12, and the third vertical parts 13 are located on the sides, close to the first horizontal parts 21, of the third horizontal parts 12; and the plurality of antenna units are divided into two antenna unit groups which are respectively arranged on two long edges of the ground plate 5. Preferably, the number of the antenna units in one antenna unit group is equal to the number of the antenna units in the other antenna unit group.

Next, the MIMO antenna capable of covering all operating frequency bands below 6 GHz of the 5G system in this embodiment is illustrated. As shown in FIG. 2 and FIG. 3, each of two antenna unit groups includes four antenna units. For a better description, the four antenna units in each antenna unit group are respectively named as a first antenna unit 6, a second antenna unit 7, a third antenna unit 8 and a fourth antenna unit 9, wherein the first antenna unit 6, the second antenna unit 7, the third antenna unit 8 and the fourth antenna unit 9 are sequentially arranged along one long edge of the ground plate 5; and the first antenna unit 6 and the fourth antenna unit 9 are symmetrically arranged with respect to an axis which penetrates through the central point of the long edge and is perpendicular to the upper surface of the ground plate 5, and the second antenna unit 7 and the third antenna unit 8 are symmetrically arranged with respect to the axis which penetrates through the central point of the long edge and is perpendicular to the upper surface of the ground plate 5. A resonant frequency from 3.3 GHz to 5 GHz can be generated by adjusting the sizes of the feeders 1 and the radiators 2 coupled to the feeders 1 of the first, second, third and fourth antenna units, as well as the distance between the first slot and the second slot.

In this embodiment, the radiator of the first antenna unit 6 and the radiator of the second antenna unit 7 are open in the same direction, the radiator of the third antenna unit 8 and the radiator of the fourth antenna 9 are open in the same direction, and the radiator of the third antenna unit 8 and the radiator of the first antenna unit 6 are open in opposite directions; and the distance between the second antenna unit 7 and the third antenna unit 8 is greater than the distance between the second antenna unit 7 and the first antenna unit 6.

Figure 4:
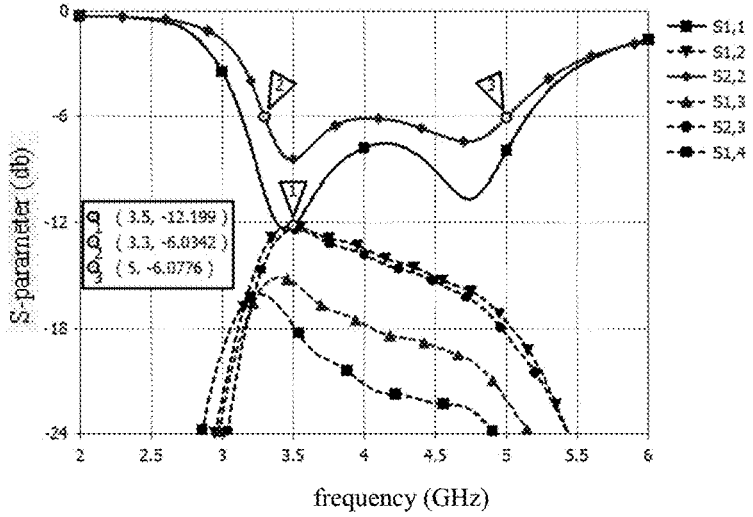
FIG. 4 is an S-parameter diagram of a first antenna unit, a second antenna unit, a third antenna unit and a fourth antenna unit in the MIMO antenna in embodiment 1 of the invention.

FIG. 4 is an S-parameter diagram of the first antenna unit, the second antenna unit, the third antenna unit and the fourth antenna unit. As shown in FIG. 4, the operating frequency of the MIMO antenna in this embodiment is 3.3-5 GHz and covers the frequency band of 3.3-3.4 GHz, the frequency band of 3.4-3.6 GHz and the frequency band of 4.8-5 GHz which are planned according to the 5G standard in China. The reflection coefficient of the MIMO antenna is better than 6 dB, and the isolation between the antenna units is better than 12 dB.

Figure 5:
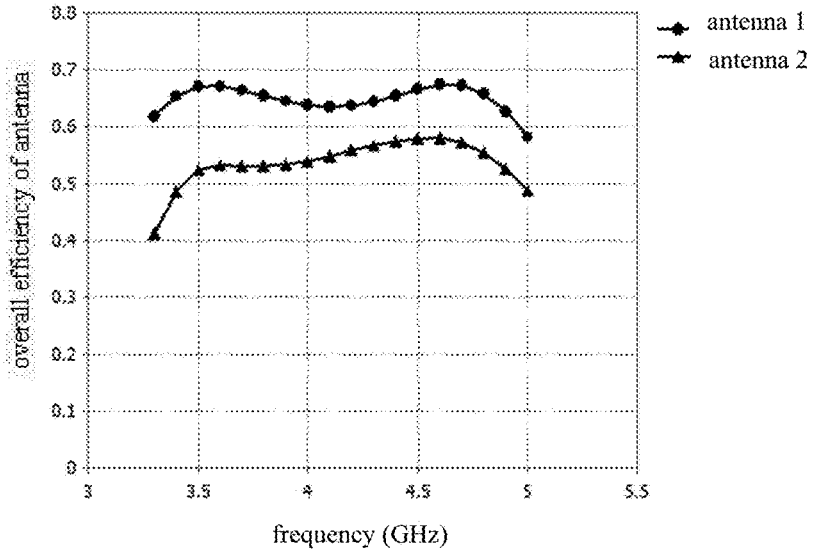
FIG. 5 is a curve chart of the variation with frequency of the total efficiency of the MIMO antenna in embodiment 1 of the invention.

FIG. 5 is a curve chart of the variation with frequency of the total efficiency of the MIMO antenna. As shown in FIG. 5, the total efficiency of the antenna is over 40% within the frequency range of 3.3-3.5 Hz.

The indexes, shown in FIG. 4 and FIG. 5, of the MIMO antenna can fully satisfy the usage requirements of a 5G 8*8 MIMO antenna system below 6 GHz in a handheld device (such as a mobile phone).

Figure 6:
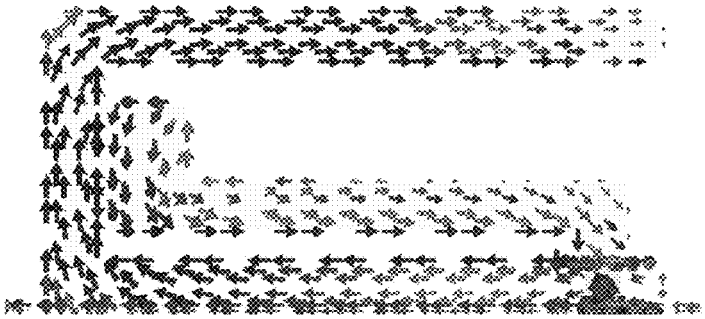
FIG. 6 is a current distribution diagram of the first antenna unit, operating at a frequency of 3.5 GHz, of the MIMO antenna in embodiment 1 of the invention.
Figure 7:
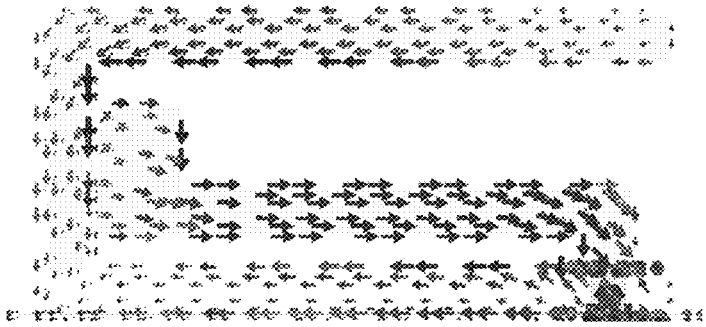
FIG. 7 is a current distribution diagram of the first antenna unit, operating at a frequency of 4.9 GHz, of the MIMO antenna in embodiment 1 of the invention.

The operating principle of the MIMO antenna in this embodiment can be further illustrated by observation and analysis of a current distribution diagram of the antenna units when the antenna operates at the frequency of 3.5 GHz and 4.9 GHz. For the sake of a brief illustration, only the operating condition of the first antenna unit 6 is analyzed in this embodiment. FIG. 6 is a current distribution diagram of the first antenna unit 6 operating at a frequency of 3.5 GHz, and as can be seen from FIG. 6, current peaks are distributed at the tail end (the second vertical part 11) of the feeder 1 of the first antenna unit 6 and on the radiator 2 of the first antenna unit 6. FIG. 7 is a current distribution diagram of the first antenna unit 6 operating at a frequency of 4.9 GHz, and as can be seen from FIG. 7, the current peak is distributed in the middle of the feeder 1 of the first antenna unit 6. The antenna unit effectively utilizes the structures of the feeder 1 and the radiator 2, as well as the two slots (the first slot and the second slot) between the feeder 1 and the radiator 2 to generate two adjacent dual resonances, and thus, the antenna unit in the MIMO antenna has an ultra wideband.

A handheld device provided with the MIMO antenna (not shown), such as a mobile phone, a tablet computer or a code scanner, comprises a shell and a PCB arranged in the shell, wherein the ground plate 5 serves as the PCB, and the feeders 1 of the antenna units are fixed to the inner wall of the shell.

The 5G 8*8 MIMO antenna operating at the frequency of 3.3 GHz-5 GHz below 6 GHz is analyzed and described in this embodiment, and the design principle (antenna unit) of the antenna in this embodiment can be expanded to other operating frequency bands and other m*n MIMO antenna systems (in and n are integers greater than two).

Embodiment 2

Figure 8:
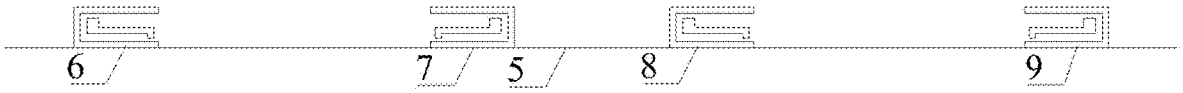
FIG. 8 is a side view of a MIMO antenna in embodiment 2 of the invention.

Referring to FIG. 8, embodiment 2 of the invention is a transformation of the antenna unit groups of the MIMO antenna in embodiment 1. Particularly, each antenna unit group includes a first antenna unit 6, a second antenna unit 7, a third antenna unit 8 and a fourth antenna unit 9 which are sequentially arranged along one long edge of the ground plate 5, wherein the first antenna unit 6 and the fourth antenna unit 9 are symmetrically arranged with respect to an axis which penetrates through the central point of the long edge and is perpendicular to the upper surface of the ground plate 5, and the second antenna unit 7 and the third antenna unit 8 are symmetrically arranged with respect to the axis which penetrates through the central point of the long edge and is perpendicular to the upper surface of the ground plate 5.

The radiator of the first antenna unit 6 and the radiator of the third antenna unit 8 are open in the same direction, the radiator of the second antenna unit 7 and the radiator of the fourth antenna unit 9 are open in the same direction, and the radiator of the second antenna unit 7 and the radiator of the first antenna unit 6 are open in opposite directions; and the distance between the second antenna unit 7 and the third antenna unit 8 is smaller than the distance between the second antenna unit 7 and the first antenna unit 6.

Embodiment 3

Figure 9:
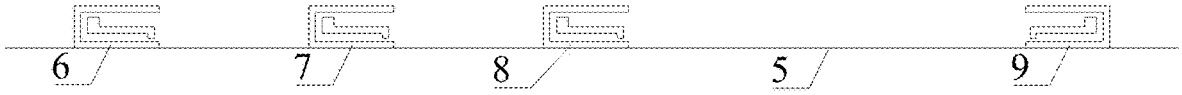
FIG. 9 is a side view of a MIMO antenna in embodiment 3 of the invention.

Referring to FIG. 9, embodiment 2 of the invention is another transformation of the antenna unit groups of the MIMO antenna in embodiment 1. Particularly, each antenna unit group includes a first antenna unit 6, a second antenna unit 7, a third antenna unit 8 and a fourth antenna unit 9 which are sequentially arranged along one long edge of the ground plate 5, wherein the radiator of the first antenna unit 6, the radiator of the second antenna unit 7 and the radiator of the third antenna unit 8 are open in the same direction, and the radiator of the fourth antenna unit 9 and the radiator of the first antenna unit 6 are open in opposite directions; and the distance between the first antenna unit 6 and the second antenna unit 7 is equal to the distance between the second antenna unit 7 and the third antenna unit 8 and is smaller than the distance between the third antenna unit 8 and the fourth antenna unit 9.

In conclusion, according to the antenna unit, the MIMO antenna and the handheld device of the invention, the antenna unit generates two adjacent dual resonances by means of the structures of the feeder and the radiator, as well as the first slot and the second slot, so that the antenna unit has an ultra wideband and is simple in structure, convenient to machine, and low in manufacturing cost; the MIMO antenna has an ultra wideband and thus can cover all frequency bands below 6 GHz for 5G mobile communications, and the performance of the antenna meet requirements; and the MIMO antenna can be vertically placed, has a small height, and thus, can be applied to ultra-thin full-screen mobile phones.

The above embodiments are only preferred ones of the invention and are not intended to limit the patent scope of the invention. All equivalent transformations based on the specification and the accompanying drawings, or direct or indirect applications to other relevant technical fields should also fall within the patent protection scope of the invention.

The invention claimed is:

1. An antenna unit, comprising:

a feeder and a radiator, wherein the radiator is in a 90°-rotated U shape and comprises a first horizontal part, a first vertical part and a second horizontal part, and two ends of the first vertical part are respectively connected to the first horizontal part and the second horizontal part;

the feeder is located in the U shape and comprises a second vertical part, a third horizontal part and a third vertical part, two ends of the third horizontal part are respectively connected to the second vertical part and the third vertical part, and the second vertical part and the third vertical part are located on different sides of the third horizontal part; and a first slot is formed between the third horizontal part and the first horizontal part, the second vertical part is close to the first vertical part, and a second slot is formed between the second vertical part and the first vertical part.

2. A multiple-input multiple-output (MIMO) antenna, comprising a ground plate and a plurality of antenna units according to claim 1, wherein the antenna units are arranged perpendicular to an upper surface of the ground plate, and the first horizontal parts of the respective antenna units are connected to the ground plate; and the plurality of antenna units are divided into two antenna unit groups which are respectively arranged on two long edges of the ground plate.

3. The MIMO antenna according to claim 2, wherein the number of the antenna units in one said antenna unit group is equal to the number of the antenna units in the other antenna unit group.

4. The MIMO antenna according to claim 3, wherein each said antenna unit group includes a first antenna unit, a second antenna unit, a third antenna unit and a fourth antenna unit which are sequentially arranged along one said long edge of the ground plate, wherein the first antenna unit and the fourth antenna unit are symmetrically arranged with respect to an axis which penetrates through a central point of the long edge and is perpendicular to an upper surface of the ground plate, and the second antenna unit and the third antenna unit are symmetrically arranged with respect to the axis which penetrates through the central point of the long edge and is perpendicular to the upper surface of the ground plate.

5. The MIMO antenna according to claim 4, wherein a radiator of the first antenna unit and a radiator of the second antenna unit are open in a same direction, a radiator of the third antenna unit and a radiator of the fourth antenna unit are open in a same direction, and the radiator of the third antenna unit and the radiator of the first antenna unit are open in opposite directions; and a distance between the second antenna unit and the third antenna unit is greater than a distance between the second antenna unit and the first antenna unit.

6. The MIMO antenna according to claim 4, wherein a radiator of the first antenna unit and a radiator of the third antenna unit are open in a same direction, a radiator of the second antenna unit and a radiator of the fourth antenna unit are open in a same direction, and the radiator of the second antenna unit and the radiator of the first antenna are open in opposite directions; and a distance between the second antenna unit and the third antenna unit is smaller than a distance between the second antenna unit and the first antenna unit.

7. The MIMO antenna according to claim 3, wherein each said antenna unit group includes a first antenna unit, a second antenna unit, a third antenna unit and a fourth antenna unit which are sequentially arranged along one said long edge of the ground plate, wherein a radiator of the first antenna unit, a radiator of the second antenna unit and a radiator of the third antenna unit are open in a same direction, and a radiator of the fourth antenna unit and the radiator of the first antenna unit are open in opposite directions; and a distance between the first antenna unit and the second antenna unit is equal to a distance between the second antenna unit and the third antenna unit and is smaller than a distance between the third antenna unit and the fourth antenna unit.

8. A handheld device, comprising the MIMO antenna according to claim 2.

9. A handheld device, comprising the MIMO antenna according to claim 3.

10. A handheld device, comprising the MIMO antenna according to claim 4.

11. A handheld device, comprising the MIMO antenna according to claim 5.

12. A handheld device, comprising the MIMO antenna according to claim 6.

13. A handheld device, comprising the MIMO antenna according to claim 7.

14. The antenna unit of claim 1, wherein, the second vertical part protrudes from the third horizontal part in a first direction, the third vertical part protrudes from the third horizontal part in a second direction, and the first direction is opposite to the second direction.

* * * * *